United States Patent [19]

Krause

[11] Patent Number: 5,043,546

[45] Date of Patent: Aug. 27, 1991

[54] PUSH-BUTTON SWITCH

[75] Inventor: Ward B. Krause, Spotsylvania, Va.

[73] Assignee: Oslo Controls, Incorporated, Cheshire, Conn.

[21] Appl. No.: 552,497

[22] Filed: Jul. 16, 1990

[51] Int. Cl.[5] ..... H01H 19/28

[52] U.S. Cl. ..... 200/527; 200/314; 200/526; 200/283

[58] Field of Search ..... 200/526, 527, 528, 523, 200/314, 283, 284

[56] References Cited

U.S. PATENT DOCUMENTS

| | | | |
|---|---|---|---|
| 1,842,264 | 1/1932 | Greter . | |
| 2,945,111 | 7/1960 | McCormick . | |
| 2,956,446 | 10/1960 | Ensign, Jr. et al. . | |
| 3,051,132 | 8/1962 | Johmann . | |
| 3,223,072 | 12/1965 | Bross . | |
| 3,437,775 | 4/1969 | Piber . | |
| 3,523,168 | 8/1970 | Holmes . | |
| 4,230,921 | 10/1980 | Wearing et al. . | |
| 4,317,015 | 2/1982 | Buttner et al. | 200/526 |
| 4,319,106 | 3/1982 | Armitage . | |
| 4,345,128 | 8/1986 | Buttner et al. | 200/526 |
| 4,354,074 | 10/1982 | Aurand et al. . | |
| 4,506,124 | 3/1985 | Rose et al. . | |
| 4,891,476 | 1/1990 | Nation et al. | 200/527 X |
| 4,939,328 | 7/1990 | Smith | 200/527 |
| 4,996,401 | 2/1991 | Pack | 200/527 |

FOREIGN PATENT DOCUMENTS

| | | |
|---|---|---|
| 900299 | 7/1962 | United Kingdom . |
| 915522 | 1/1963 | United Kingdom . |

*Primary Examiner*—Ernest G. Cusick

*Attorney, Agent, or Firm*—Banner, Birch, McKie & Beckett

[57] ABSTRACT

A push-button switch comprises a housing having a substantially cylindrical interior portion. It also includes a movable switching member, disposed substantially within the interior of the housing and having a reciprocally movable plunger with successive released, latched and depressed positions relative to the housing interior portion. Functional surfaces of substantially cylindrical form are disposed adjacent and in a substantially fixed position relative to the interior portion of the housing and include guiding surfaces aligned in the direction of movement of the plunger. The plunger has members, interengaging with the guiding surfaces, for preventing rotation of the plunger during reciprocal movement of the plunger. The movable switching member also includes a rotatable latch ring, preferably C-shaped, disposed on the plunger and having a radially extending lug. The plunger also has members for holding the rotatable ring in a fixed latitudinal position about a portion of the plunger. The functional surfaces also include radially spaced lug directing surfaces disposed so that when the plunger is moved into its depressed position, a lug directing surface contacts the lug to rotate the ring. The functional surfaces further include radially spaced lug latching surfaces, circumferentially offset from the lug directing surfaces and disposed so that every other time the plunger is moving from its depressed toward its released position, a lug latching surface contacts the lug to restrain the plunger in its latched position. The radially spaced lug directing surfaces are preferably molded integrally on a base of the switch and the radially spaced lug latching surfaces are preferably molded integrally on the housing interior portion. The lugs preferably have a first surface which is aligned with the direction of movement of the plunger and second and third surfaces which are inclined relative to the first surface.

27 Claims, 11 Drawing Sheets

30
40
40
50
60
61
62
64
66
68
80
83
100
101
102
106
107
108
110
120
121
122
140
144
160
162
164
166
170
172
180
190
42
47

PUSH-BUTTON SWITCH

BACKGROUND OF THE INVENTION

This invention relates to a latching mechanism and more particularly to switches, writing instruments and the like which are round in configuration and require a latching function.

Round push-button switches are used for keyboard shifting on computers, typewriters or the like and as panel mounted devices for instrumentation, electronics and controls. The known round push-button switches which provide a latching function have drawbacks, however. Two of these problems are difficulty in assembling the latching mechanism and reliability of the latching mechanism.

Round cylinder switches provide an advantage in that opposite sides of a switch plunger can be simultaneously locked down. Having two sides simultaneously locked down increases the reliability of the switch and also makes the plunger rest level in the latched position. U.S. Pat. No. 3,437,775 to Piber discloses a round push-button switch including a cammed surface liner inserted into a circular housing. Piber also includes a continuous collar which rotates on a carrier and includes round lugs. The round lugs of the collar engage the cammed surfaces of the liner.

There may be, however, a difficulty in assembling the Piber structure, because one has to line up and position separate cam surfaces within the housing to obtain an interior portion having cam surfaces. Where the rolled liner is joined in the housing interior, one may introduce a discontinuity, ridge or seam to the cam surface. Such a discontinuity at the rolled up ends of the cam surface could interrupt or hang up a lug during ring rotation. Also, assembly of the continuous ring onto the collar may be difficult and time consuming. Further, the point-to-point contact between round lugs and saw teeth cammed surfaces is not as reliable as desired.

In a traditional ballpoint pen mechanism, the center plunging member rotates by following a saw tooth pattern molded into the housing to create a lock-down function. For example, U.S. Pat. No. 3,051,132 to Johmann does not have a separate rotating latching ring. Instead, the entire spring loaded cam shaft is rotating. Thus, one may not be able to advantageously use the rotating cam shaft for other functions such as contacting fixed position terminals for reliably closing a circuit.

Also, traditional ballpoint pen mechanisms normally have a freely floating button so there is no indication from the switch position of when it is in the on position.

The present invention is directed towards eliminating deficiencies found in the above-identified prior art.

SUMMARY OF THE INVENTION

It is an object of the present invention to allow one to use a non-rotating plunger to advantageously form electrical connections for reliably closing a circuit.

It is also an object of the present invention to provide a more reliable and easier to assemble round switch having a latching function than known round switches offering a latching function.

A preferred switch includes a housing having a substantially cylindrical interior portion. The switch also includes a movable switch member, disposed substantially within the interior of the housing and having a reciprocally movable plunger with successive released, latched and depressed positions relative to the housing interior portion. The mechanism also includes functional surfaces of substantially cylindrical form, disposed adjacent and in a substantially fixed position relative to the interior portion of the housing. These functional surfaces include guiding surfaces aligned in the direction of movement of the plunger.

The preferred plunger has a member, interengaging with the guiding surfaces, for preventing rotation of the plunger during reciprocal movement of the plunger. The movable switching member also includes a rotatable latch ring disposed on the plunger which has a radially extending lug. In addition, the plunger has members for holding the rotatable ring in a fixed latitudinal position about a portion of the plunger.

The functional surfaces also include radially spaced lug directing surfaces so that when the plunger is moved into its depressed position, a lug directing surface contacts the lug to rotate the ring. The functional surfaces also include radially spaced lug latching surfaces, circumferentially offset from the lug directing surfaces so that every other time said plunger is moving from its depressed position towards its released position, a lug latching surface contacts the lug of the ring to restrain the plunger in its latched position.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EMBODIMENTS

Illustrated in FIGS. 1–4B is push-button switch 30. This switch includes housing 40 having substantially cylindrical interior portion 42.

Figures 1, 2:
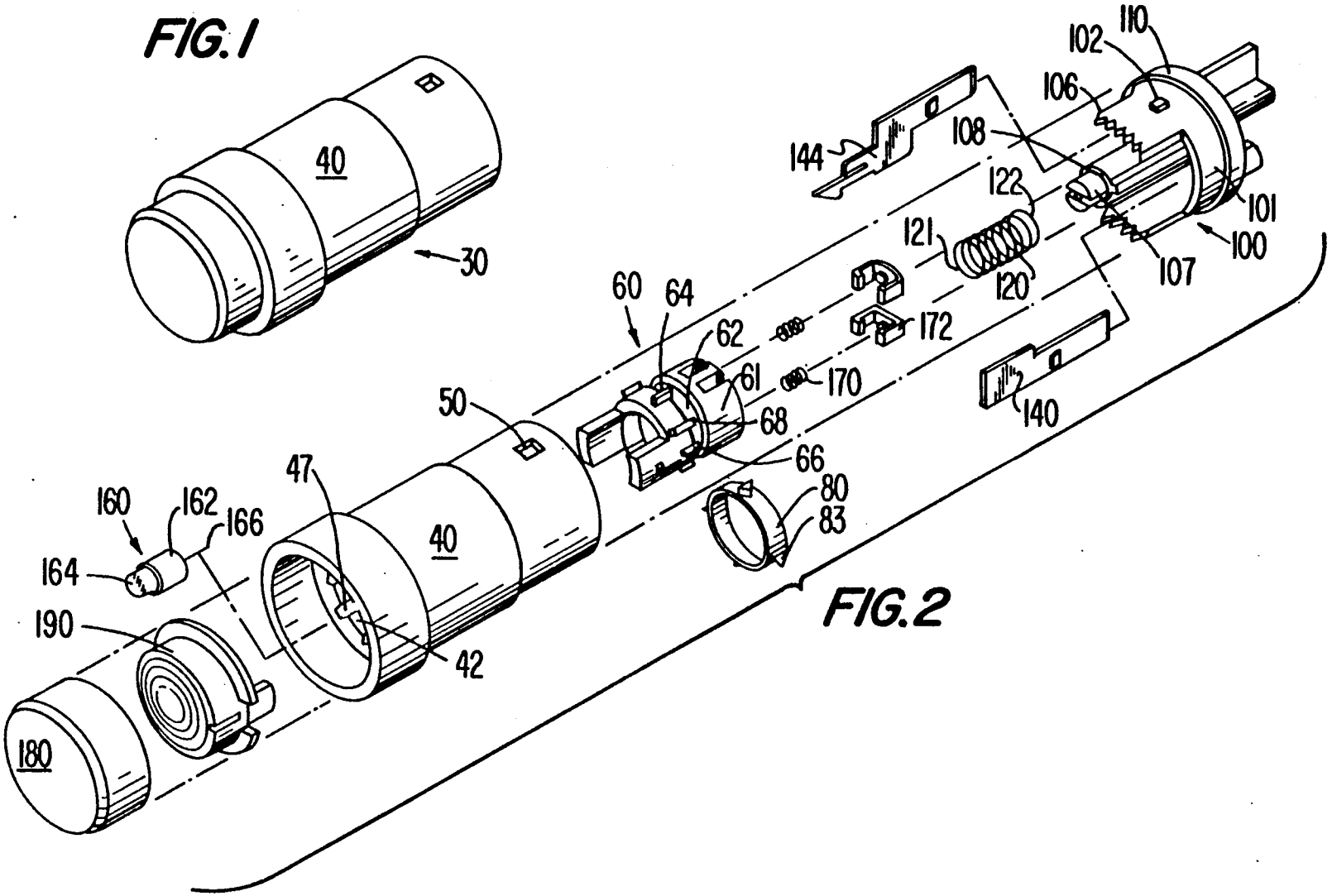
FIG. 1 is a perspective view of an embodiment of a round push-button switch of the present invention.
FIG. 2 is an exploded perspective view of the round push-button switch of FIG. 1.
Figure 3:
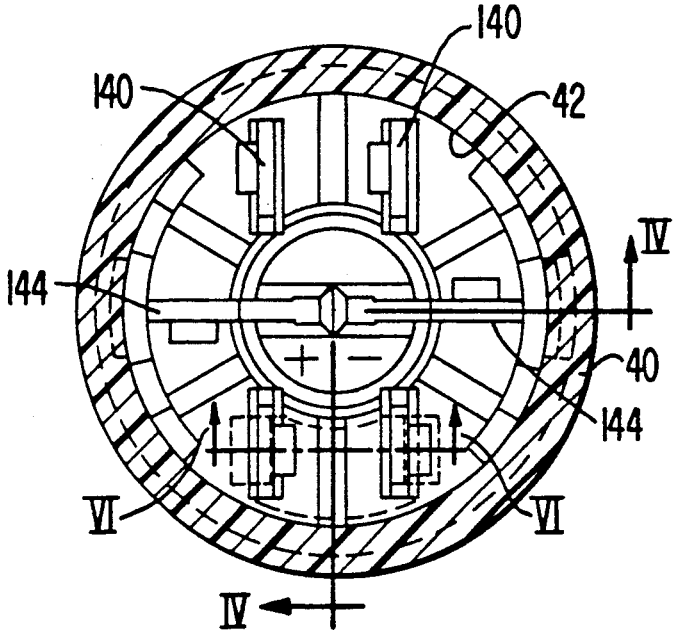
FIG. 3 is a top sectional view of the round push-button switch of FIG. 2 showing terminals within the interior of the switch.
Figure 6:
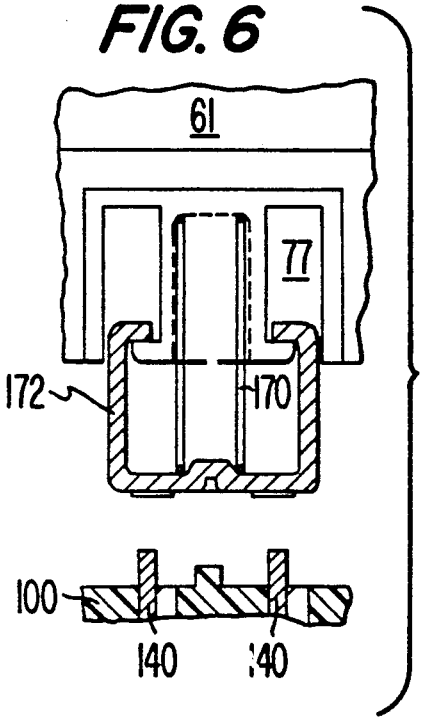
FIG. 6 is a sectional view along line VI—VI of FIG. 3 of a spring and slidable terminal disposed on a plunger and above terminals disposed in a base.
Figure 4A:
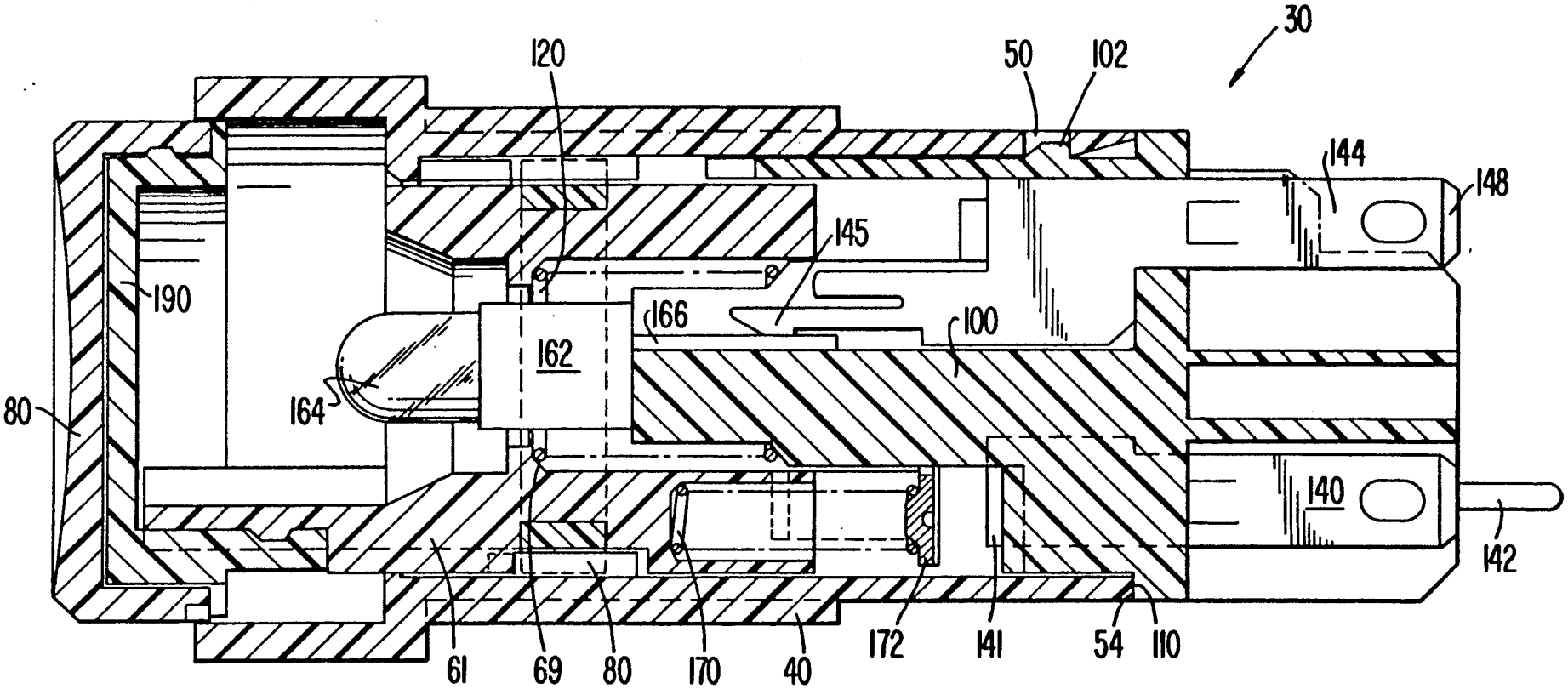
FIG. 4A is a side sectional view along line IV—IV of FIG. 3 of the switch in a released position.
Figure 4B:
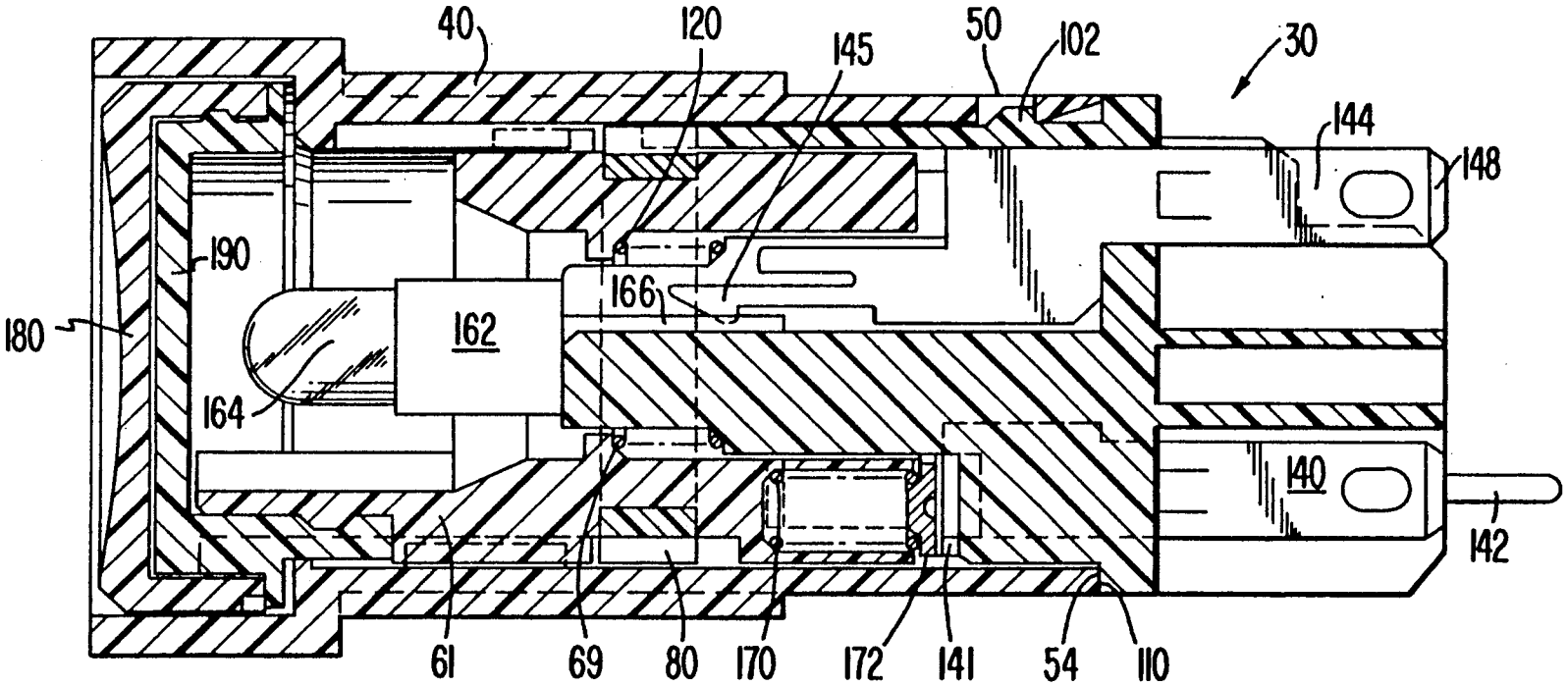
FIG. 4B is a side sectional view along line IV—IV of FIG. 3 of the switch in a depressed position.
Figure 7:
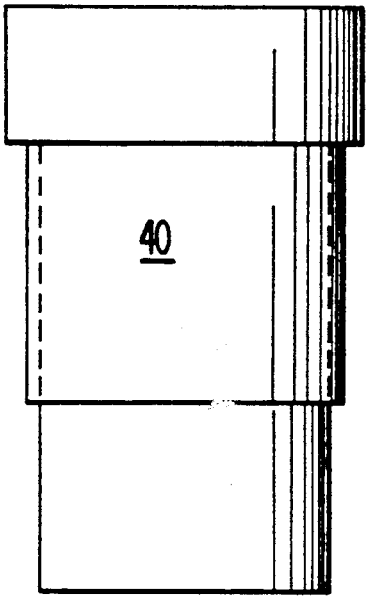
FIG. 7 is a side view of the housing of the switch of FIG. 2.
Figure 8:
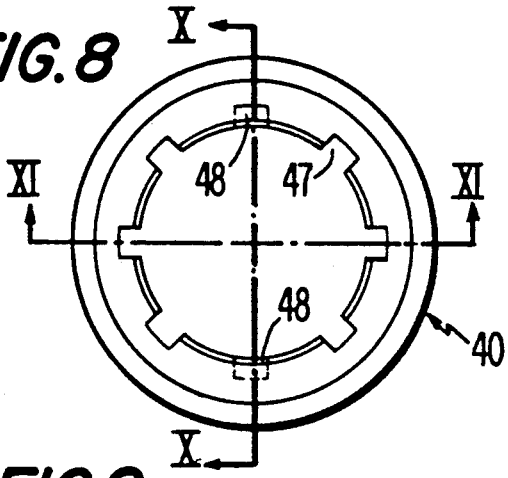
FIG. 8 is a top view of the housing of FIG. 7.
Figure 9:
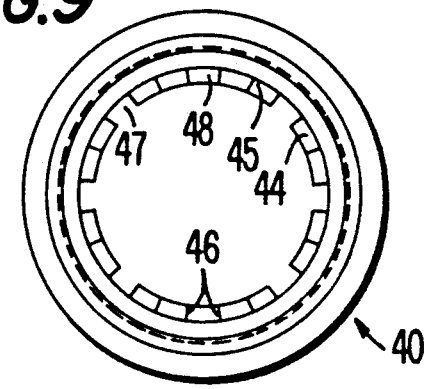
FIG. 9 is a bottom view of the housing of FIG. 7.

This switch also includes movable switching member 60 which is disposed substantially within the interior of housing 40 and includes two elements. First, it includes reciprocally movable plunger 61 having successive released, latched and depressed positions relative to housing interior portion 42. In the housing of FIG. 2, the depressed position relative to the housing is closer to the end of housing 40 having slot 50. The latched and released positions are further from this same end. FIG. 4A illustrates plunger 61 in a released position relative to housing interior portion 42. FIG. 4B illustrates plunger 61 in a depressed position relative to housing interior portion 42.

Plunger 61 includes ribs, projections or the like 64, 66 and 68 slidably engaged in recesses 47 on the interior portion 42 of housing 40. These ribs prevent rotation of the plunger during reciprocal movement of the plunger within the housing.

As illustrated in FIG. 2, movable switching member 60 also includes rotatable latch ring 80 having radially extending lugs 83. On plunger 61 is a groove 62 for holding rotatable latch ring 80 in a fixed latitudinal or fixed vertical position about a portion of the plunger.

Biasing member 120 of FIG. 2 is disposed substantially within the interior of housing 40 for biasing plunger 61 towards its released position in the absence of sufficient pressure on the plunger in the opposite direction. For example, compare the position of biasing member 120 when the plunger is in a released position in FIG. 4A to its position when the plunger is in a depressed position in FIG. 4B.

Base 100 of FIG. 2 has a substantially cylindrical portion 101 disposed in a substantially fixed position within the interior of housing 40. As seen in FIGS. 4A and 4B, base 100 has projection 102 which engages slot 50 of the housing. Also, the base has platform 110 on which bottom 54 of housing 40 rests. Further, the substantially cylindrical portion 102 of the base includes a plurality of saw teeth 106 which are molded integrally to the base. When the plunger 61 is moved into its depressed position, saw teeth 106 of base 100 contact lugs 83 of the latch ring to rotate the ring.

Base 100 also includes rod 107 with shelf 108 for receiving end 122 of biasing member 120. As seen in FIGS. 4A and 4B, plunger 61 includes shelf 69 for receiving an opposite end 121 of biasing member 120.

FIGS. 2, 4A and 4B illustrate button 180 and diffuser 190. Button 180 and diffuser 190 can be placed on top of plunger 61 for enhancing the user friendliness of switch 30.

Shown in FIGS. 4A and 4B are terminals 140 and 144 disposed in the base. Each terminal has a first end 141, 145, respectively, projecting from the base into the interior of the housing and a second end 142 and 148, respectively, projecting outside of the housing from an opposite portion of the base.

Figure 27:
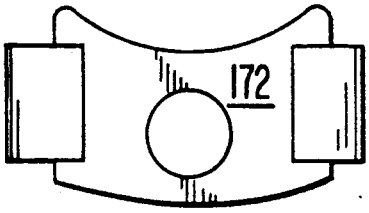
FIG. 27 illustrates a top view of the slidable terminal of FIG. 6.
Figure 28:
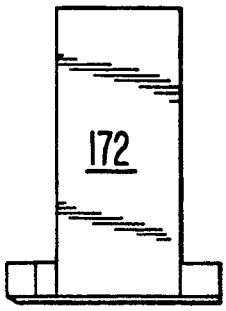
FIG. 28 illustrates a side view of the slidable terminal of FIG. 27.

Shown in FIGS. 2, 4A, 4B and 6 are electrical terminals 172 slidably disposed on a portion of plunger 61. FIGS. 27 and 28 show additional views of terminal 172. Spring 170 of FIGS. 2, 4A, 4B and 6 has one end received by plunger 61 and another end received by terminal 172. Spring 170 forces slidable terminal 172 against a pair of terminals 140 associated with base 100 when the plunger is in its depressed and in its latched positions. By not allowing the plunger to rotate, plunger 61 keeps slidable terminal 172 in alignment with terminals 140 while plunger 61 reciprocates.

It is preferred that when plunger 61 reaches its depressed and its latched positions, lighting member 160 of FIG. 2 is illuminated. Lighting member 160 is disposed within the interior of housing 40. As seen in FIGS. 2, 4A and 4B, lighting member 160 includes leads 166, socket 162 and bulb 164. Bulb 164 can be any illuminating device such as an LED, incandescent bulb or even a neon bulb if a resistor is added. When an incandescent bulb or an LED is used, the lamp has two leads 166 which run along a dividing wall of base 100. It is leads 166 which are contacted by lamp terminals 144 in the plunger's depressed and latched positions to provide the power to illuminate bulb 164.

If an LED is used, a spacer is likely needed, because the LED leads are a little wider apart than the incandescent leads. Thus, a separator would be required so that the LED can sit high enough to not interfere with the plunger 61. Finally, having a socket provided for by lamp terminals 144 and separate bulb allows for easy replacement of the bulb by merely removing diffuser 190 and button 180.

Illustrated in FIGS. 7–11 is housing 40. On substantially cylindrical interior portion 42 of housing 40 are radially spaced lug latching cam surfaces 44 and 45 which define saw teeth 43 of housing 40. Tooth surface 45 is aligned with the direction with movement of the plunger (i.e. in a vertical alignment in FIGS. 10 and 11). Tooth surface 44 is inclined relative to surface 45.

Each tooth 43 is separated by guiding surfaces 46 which define recesses 47 aligned in the direction of movement of the plunger. The guiding surfaces 46 and teeth 43 are preferably molded integrally to housing interior portion 42.

There are performance and assembly advantages to having guiding surfaces 46 and teeth molded integrally to the housing and having teeth 106 molded integrally to the base. There is no separate cam surface liner to mold or assemble. Also, there is little possibility of a discontinuity or ridge between cam surfaces to hang up the lug during rotation.

Although not as advantageous as being molded integrally onto the housing interior portion, these functional surfaces of a substantially cylindrical form, including the guiding surfaces and saw teeth, could alternatively be separate from but placed in a substantially fixed position relative to the interior portion of the housing. For example, they could be in frictional engagement with the interior portion of the housing.

As seen in FIGS. 8–11, guiding surfaces 46 which define recesses 47 can include a top surface 48 or the like integrally molded on the interior portion of the housing. This top surface stops further movement of the plunger in a direction away from the plunger's depressed position by contact with the plunger rotation preventing ribs when the plunger is moved by biasing member 120 to its released position. It is preferred to have top surface 48 at least contact plunger rotation preventing ribs on each of two opposite sides of the plunger. This contact with ribs on opposite sides of the plunger will hold the plunger substantially level in housing 40. It will also likely prevent a possible slip which could happen if there was only one engagement with the plunger at its released position.

Figure 10:
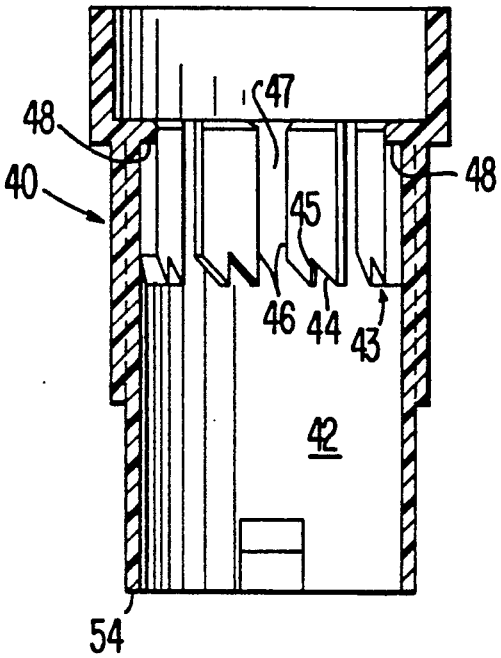
FIG. 10 is a side sectional view of the housing along line X—X of FIG. 8.
Figure 11:
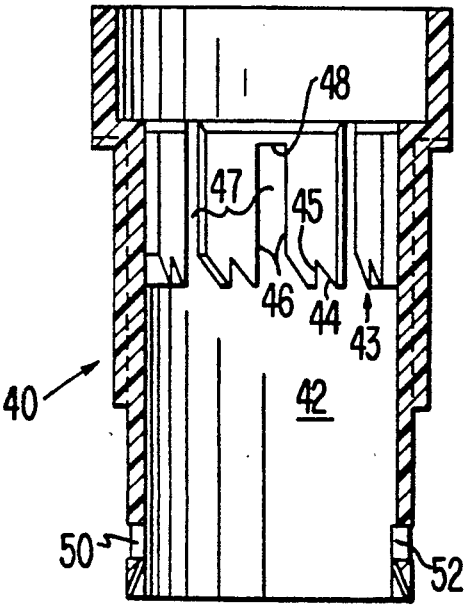
FIG. 11 is a side sectional view of the housing along line XI—XI of FIG. 8.
Figure 12:
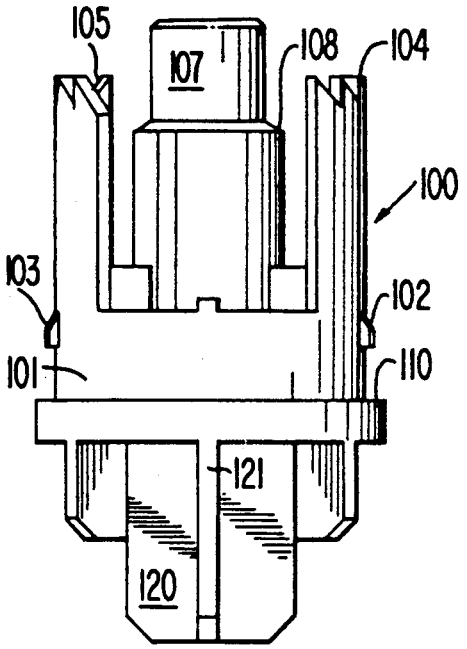
FIG. 12 is a side view of the base of the switch of FIG. 2.

FIG. 10 illustrates bottom of housing 54. Also, FIG. 11 shows first and second slots 50 and 52 for receiving projections from base 100.

Figure 5:
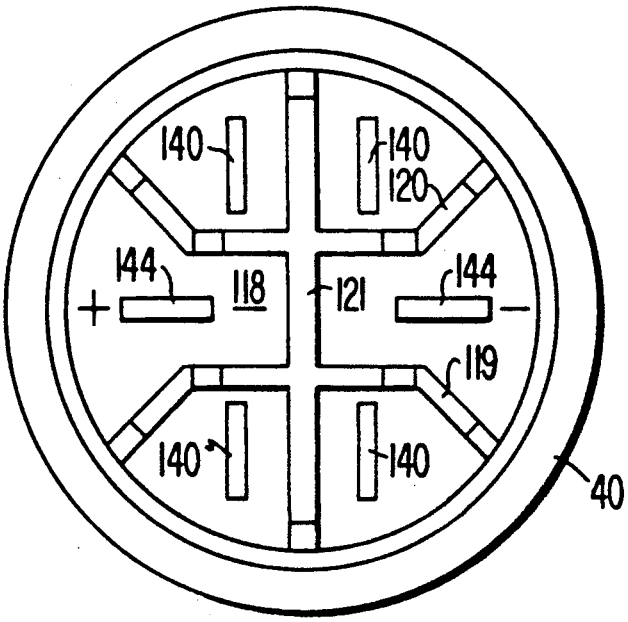
FIG. 5 is a bottom view of the switch of FIG. 2.

Base 100, illustrated at least in FIGS. 2, 4A, 4B, 6 and 12–16, has a substantially cylindrical portion 101 disposed in a substantially fixed position within the interior of housing 40 aligned by means of corresponding projections 102 and 103 in the base and slots 50 and 52 in the housing. To allow installation of terminals 140 and 144 of FIGS. 2, 3 and 5 within base 100, installation of movable switching member 60 into housing 40, and to allow molding of the cam surfaces of the interior portion of housing 42 and base 100, base 100 and housing 40 are designed as separate parts rather than one piece. Furthermore, base tooth surface 104 is aligned with the direction of movement of the plunger and base tooth surface 105 is inclined relative to base tooth surface 104.

Figure 13:
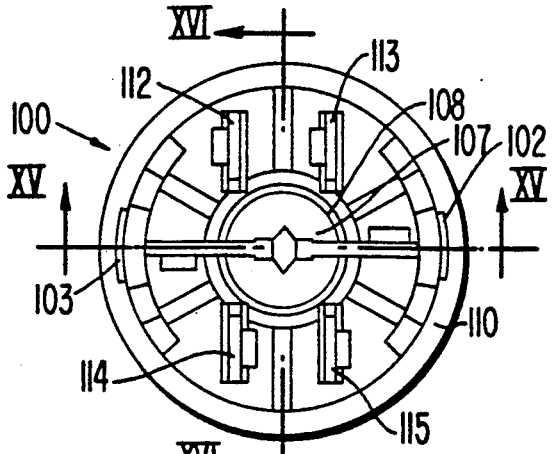
FIG. 13 is a top view of the base of FIG. 12.
Figure 14:
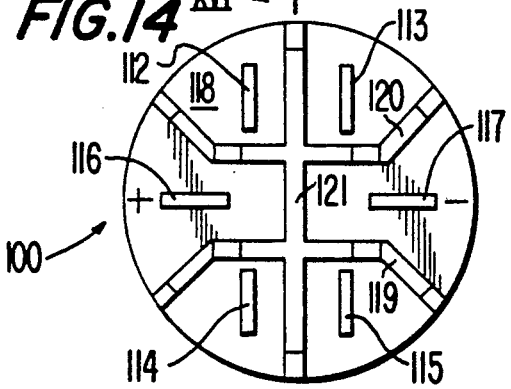
FIG. 14 is a bottom view of the base of FIG. 12.
Figure 15:
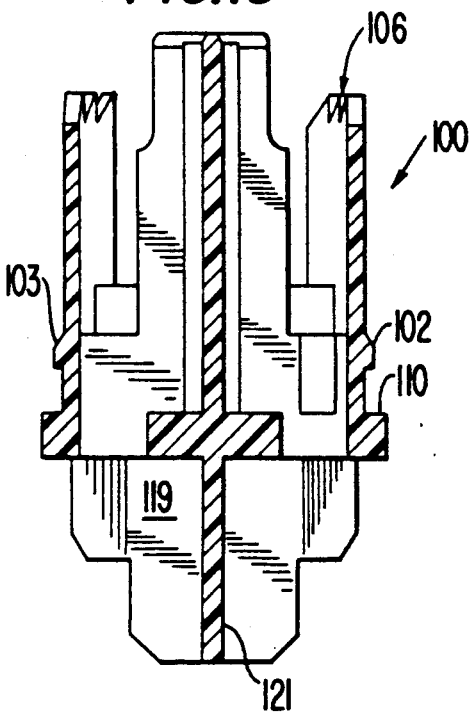
FIG. 15 is a side sectional view of the base along line XV—XV of FIG. 13.
Figure 16:
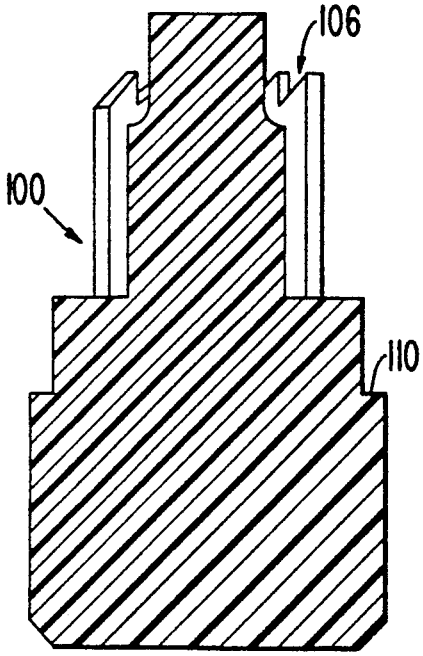
FIG. 16 is a side sectional view of the base along line XVI—XVI of FIG. 13.

Seen in FIGS. 13 and 14 are slots in base 100 for six terminals. There are two slots 112 and 113 (one pole) at one portion and two slots 114 and 115 (a second pole) at another portion. These slots 112 through 115 are for receiving connection terminals 140 as in FIG. 5. Thus, if two separate circuits in the switch are desired, one could have two circuits being closed across these terminals. In addition, there are slots 116 and 117 labeled plus and minus for lamp terminals 144.

In addition, seen in FIGS. 5, 12, 14 and 15 are base bottom 118 and projections 119, 120 and 121 extending from the bottom of the base. Projections 119, 120 and 121 serve as insulating barriers between each of the terminals. Also, FIGS. 12–16 illustrate rod 107 with shelf 108 for receiving end 122 of biasing member 120, platform 110 on which bottom 54 of housing 40 rests, and projections 102 and 103 for engaging slots 50 and 52 of housing 40.

Illustrated in FIGS. 17–21 is multifunction plunger 61. Plunger 61 includes ribs or the like 64, 66 and 68 for slidably engaging recesses 47 on interior portion 42 of housing 40. These ribs or portions 64, 66 and 68 are preferably of three different sizes, with one of each size rib on opposing sides of the plunger. With the top surface 48 of housing guiding surfaces 46 preferably at the top of only two opposing recesses 47 as in FIGS. 8–11, the shortest ribs 64 preferably reside in the two recesses with top surface 48 to provide a stop which determines the released position of the plunger.

Figure 17:
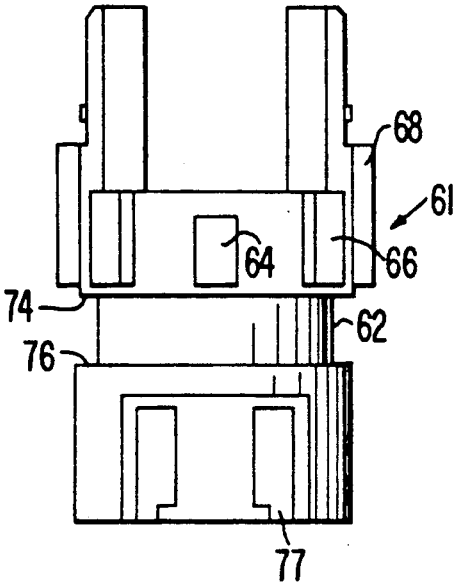
FIG. 17 is a side view of the plunger of the switch of FIG. 2.
Figure 18:
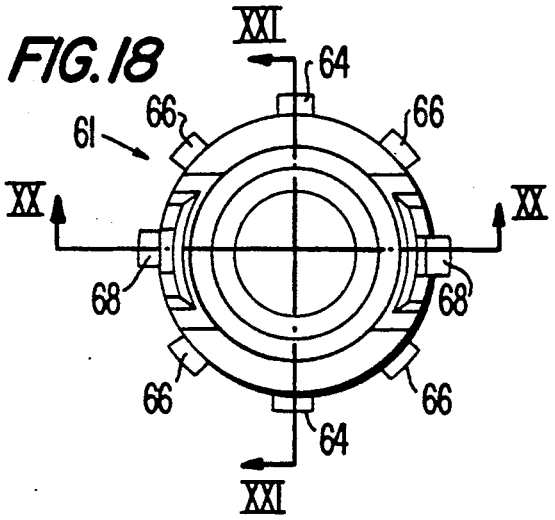
FIG. 18 is a top view of the plunger of FIG. 17.
Figure 20:
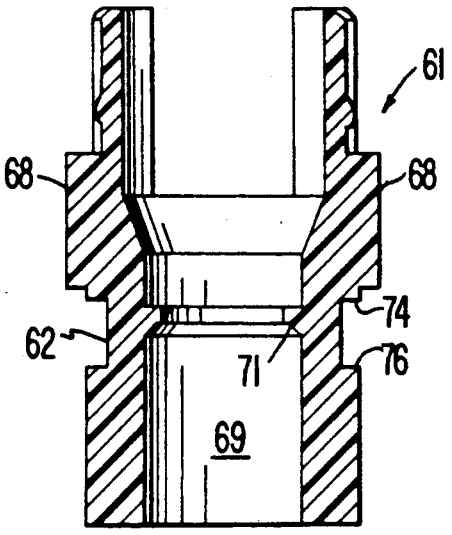
FIG. 20 is a side sectional view of the plunger along line XX—XX of FIG. 18.
Figure 21:
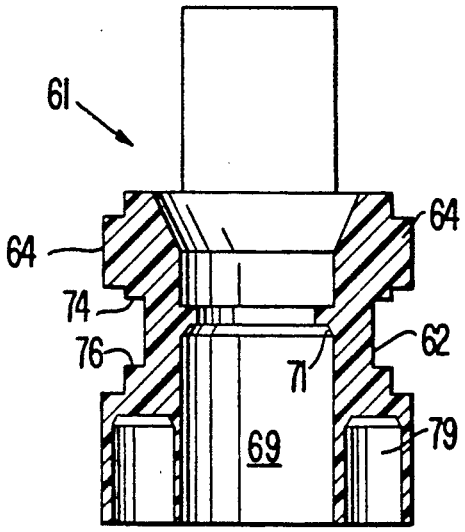
FIG. 21 is a side sectional view of the plunger along line XXI—XXI of FIG. 18.

Seen in FIGS. 17, 20 and 21 are ridges 74 and 76 of plunger 61 defining groove 62 located adjacent ribs 64, 66 and 68. Groove 62 accommodates rotating latching ring or collar 80 in a fixed latitudinal or vertical position about this portion of the plunger.

Figure 19:
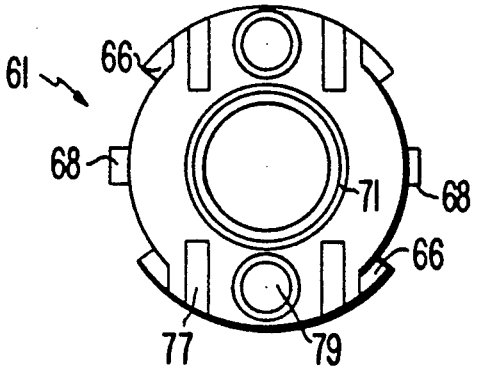
FIG. 19 is a bottom view of the plunger of FIG. 17.

Illustrated in FIGS. 19, 20 and 21 is recess 69 having shelf 71 for receiving an end 121 of biasing member 120. In FIGS. 6, 17, 19 and 21 are slots 77 for receiving terminal 172. In addition, shown in FIGS. 19 and 21 is recess 79 for receiving spring 170.

Figure 22:
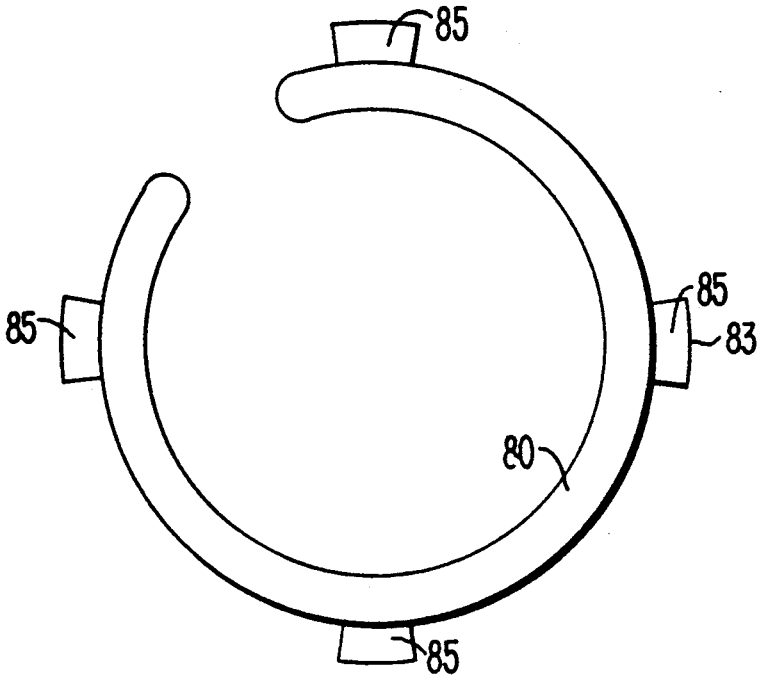
FIG. 22 is a top view of the latching ring of the switch of FIG. 2.
Figure 23:
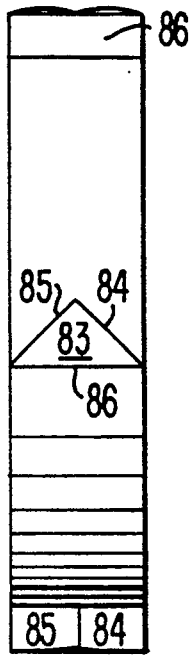
FIG. 23 is a side view of the latching ring of FIG. 22.

FIGS. 22 and 23 illustrate latching ring 80 which loosely rotates in a portion of groove 62 of plunger 61. It is preferable to have radially extending lugs 83 on a separate ring 80 from plunger 61. With lugs 83 on a separate locking ring 80, lugs 83 can rotate between stationary cam surface 45 on housing 40 and stationary cam surface 105 on base 100. Simultaneously, the plunger will not rotate so that one can obtain more reliable connections between terminals 172 in the plunger and terminals 140 in the base.

Ring 80 is preferably C-shaped as in FIG. 22. The C-shaped locking ring can be easily snapped around and then disposed on groove 62 of the plunger between ridges 74 and 76. Thus, assembly of the movable switching member 60 of FIG. 2 is relatively simple.

Figure 24:
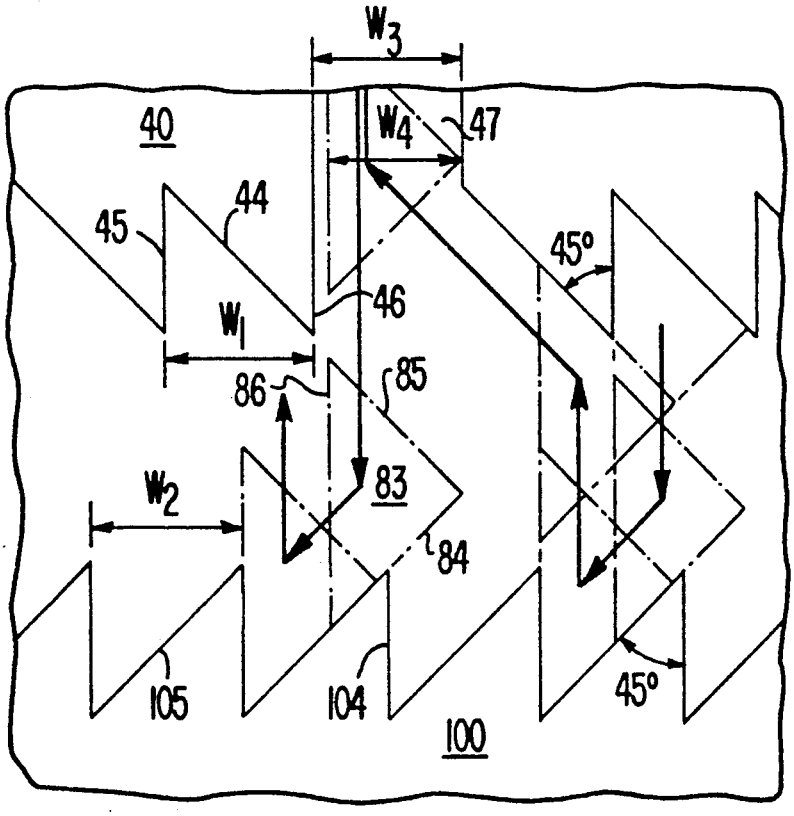
FIG. 24 illustrates the movement of a triangular-shaped lug of the ring between the teeth and a recess of the housing and the teeth of the base.

As seen in FIGS. 23 and 24, each lug 83 of ring 80 has first surface 86 which is aligned with the direction of movement of the plunger. Each lug 83 also includes second 84 and third 85 surfaces which are inclined relative to first surface 86. As illustrated in FIG. 24, each lug 83 is preferably shaped to obtain a cooperating relationship with teeth 43 on housing 40 and teeth 106 on base 100. It is further preferable that first 86, second 84 and third surfaces 85 of each lug 83 define a triangular side wall shape. It is more preferable that the triangular side wall shape have two sides 84 and 85 of equal length to define an isosceles triangle shape.

Teeth 43 of housing 40 are circumferentially offset approximately one-half the width of lug directing saw teeth 106 of base 100. With the circumferentially offset teeth relationship between the housing and base, lug 83 can engage a tooth of both of the housing and base. When the plunger 61 is in a depressed position, lug 83 of locking ring 80 engages tooth 106 of base 100. Then, every other time the plunger is released from its depressed position, the same lug 83 engages tooth 43 of housing 40 and the plunger is in its latched position.

As seen in FIG. 24, when plunger 61 is moved into its depressed position, inclined surface 105 of the base contacts second surface 84 of lug 83 to rotate the ring. Consequently, second surface 84 of lug 83 is in surface-to-surface contact with surface 105 of base teeth 106 when the plunger is moved into its depressed position.

Also as seen in FIG. 24, upon alternate releases of the plunger from the depressed position, latching surface 44 of the housing 40 contacts third surface 85 of lug 83 and the plunger is in the latched position. Consequently, third surface 85 is in surface-to-surface contact with surface 44 of housing teeth 43 every other time the plunger is released from its depressed position.

Figure 25:
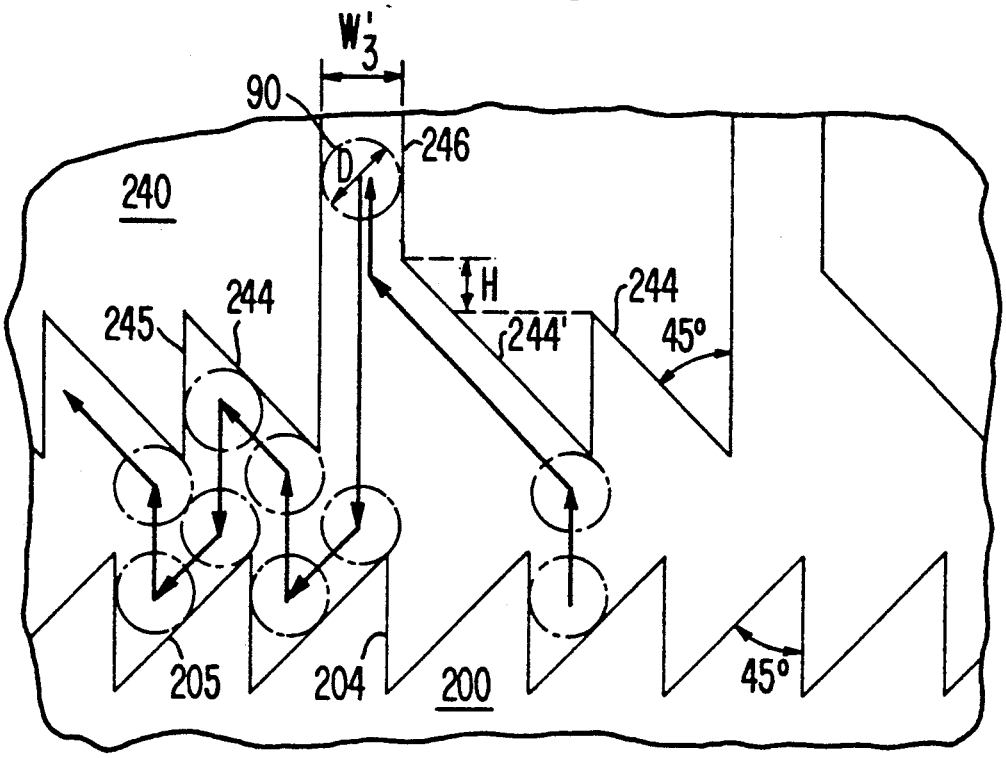
FIG. 25 illustrates the movement of an alternative round-shaped lug between the teeth and a recess of the housing and the teeth of the base.

This surface-to-surface contact of a lug surface with the base and housing teeth is preferred. Surface-to-surface contact between lug and teeth surfaces promotes a more even force distribution to improve the moving of a lug to the desired position on the saw teeth. In contrast, point-to-point contact between round lug 90 and a saw tooth, as seen in FIG. 25, is more likely to result in a malfunction in the switch such as jamming of the lug.

The depressed and latched positions are defined generally as positions where the inclined surfaces 84 and 85 of lug 83 have been slid far enough along inclined surfaces 105 and 44 to move past the point of the circumferentially offset opposite tooth. Thus, surface 86 of lug 83 does not have to come in contact with surfaces 104 or 45 to be in the depressed or latched positions. In fact, it is preferable that such contact with surfaces 104 or 45 (i.e. bottoming out of the lug) is not made, because this could dull the points of the lug and eventually introduce the problems faced with rounded lugs. As mentioned, what will preferably stop upward movement of lug 83 is the contact of rib 64 of plunger 61 with top surface 48 of housing guiding surfaces 46. Likewise, a stop (not shown) can be included to stop downward movement of lug 83 in the depressed position before lug surface 86 contacts surface 104.

When lug 83 is latched, this lowered position of the plunger will indicate that the switch is on. This is important in applications where no lamp is provided, but an indicator of whether the switch is on or off is needed for safety or desired for informational purposes or aesthetics.

With four lugs 83 equally spaced on latching ring 80, at least two of the lugs are engaging teeth 43 of housing 40 when the plunger is in its latched position. Although only one lug could be used, having a plurality of lugs 83 on the ring which engage teeth 43 facilitates letting the plunger rest level in the latched position.

Switch 30 can be made to any dimensions in accordance with the disclosure. It is preferable for most applications, however, to have a switch of less than two inches in length and less than three-quarters of an inch in width or diameter.

As seen in FIG. 24, width $w_1$ of housing inclined surface 44 should preferably equal width $w_2$ of base inclined surface 105. Also, width $w_3$ of recesses 47 should equal width $w_1$ and $w_2$ of inclined surfaces 44 and 105, respectively. In addition, widths $w_1$, $w_2$ and $w_3$ should preferably be slightly greater than width $w_4$ of inclined surfaces 84 and 85 of lugs 83. Lugs 83 of the locking ring should then preferably initially engage at least one-third to one-half of width $w_2$ of base surface 105 when the plunger is moving towards its depressed position. These preferred relationships leave little room for slipping of the lugs.

It is also preferred that the inclined surfaces 44 and 105 be at approximately a 45° angle to their respective surfaces 45 and 104 which are aligned with the direction of movement of the plunger. There is a trade-off between the distance to which the lugs 83 must travel and the angles of the contacting tooth surfaces. With a relatively sharply angled inclined surface (angled less than 30° from the surfaces aligned with the direction of movement of the plunger) there is a greater distance for the plunger to have to travel in order to rotate or to be latched. With a relatively flattened angle on the inclined surfaces (angled more than 60° from the surfaces aligned with the direction of movement of the plunger), the distance which lugs 83 must travel to rotate and be latched is less, but the force favoring the direction of rotation for the lug is also less. This may prevent complete rotation and result in failure of the alternate latching function.

Consequently, a 45° angle to the inclined surface of the saw teeth is the preferred angle for balancing these considerations. At approximately 45°, the distance the projection lug must travel is reasonable while the angle of incline is sufficiently large or defined to reduce the likelihood of the lug jamming.

Although triangular lugs are preferred, round lugs 90 could be used in an alternative embodiment of FIG. 25 having cam surfaces 244 and 245 of housing 240 and cam surfaces 204 and 205 of base 200. As illustrated in FIG. 25, however, in order to use round lug 90 with 45° inclined surfaces 244 and 205, every other housing inclined surface 244' (which acts as a ramp to guiding surface 246) may have to be extended by height H over the cam surface arrangement in FIG. 24. Also, diameter D of lug 90 and the corresponding slot width $w_3'$ should preferably be narrowed. There is, however, the possibility of slipping with the relatively small round lug of FIG. 25. Thus, one may need to use a larger lug and flatten the inclined surfaces.

Figure 26:
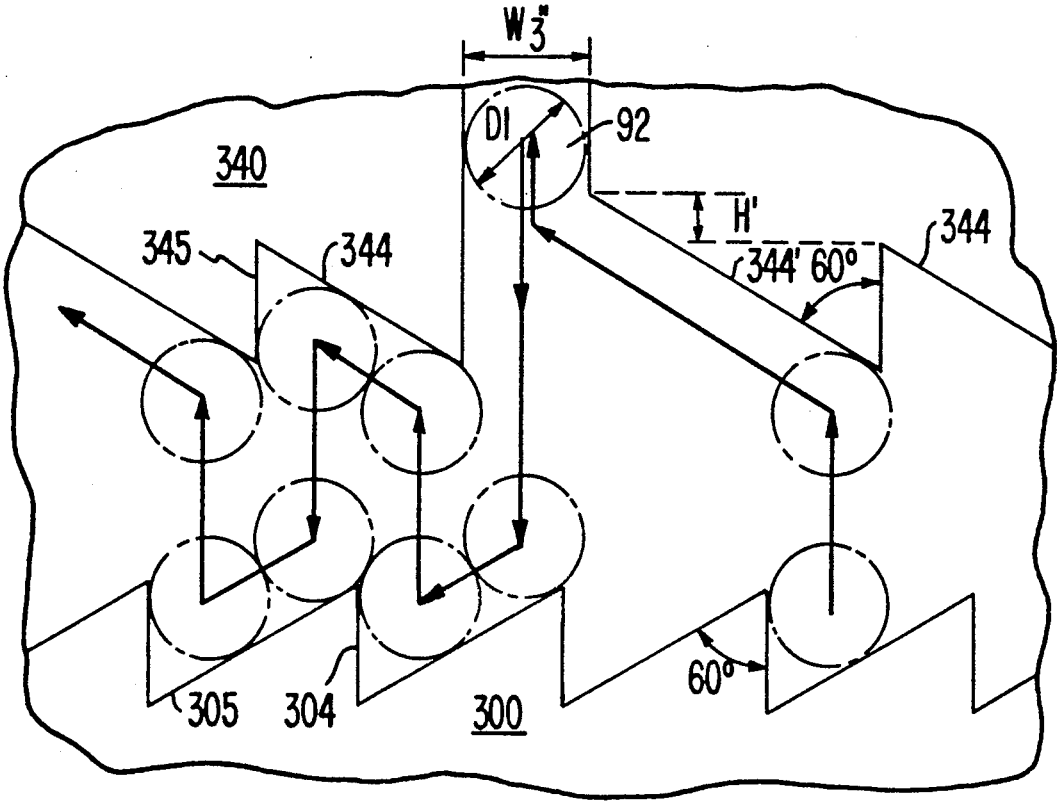
FIG. 26 illustrates the movement of a round-shaped lug between the teeth and a recess of the housing and the teeth of the base with the inclined surfaces of the teeth being angled at 60° from the surfaces of the teeth which are aligned with the direction of movement of the plunger.

FIG. 26 illustrates another embodiment having cam surfaces 344 and 345 of housing 340 and cam surfaces 304 and 305 of base 300. In this embodiment of FIG. 26, inclined base and housing saw teeth 344 and 305 are disposed at a 60° angle to the surfaces 345 and 304 which are aligned with the direction of movement of the plunger. Even with this modification to the angle, every other inclined surface 344' should still be extended by a height H' to better accommodate a round lug. A change to the 60° angle inclined surfaces does allow, however, diameter $D_1$ of lug 92 and recess width $w_3''$ to be larger than in FIG. 25. As mentioned, however, this 60° inclined surface angle is not as reliable, because it increases the likelihood that lug 92 may jam and not rotate completely as intended. For example, compare the points of contact of surface 305 with lug 92 in FIG. 26 to the points of contact of surface 205 with lug 90 in FIG. 25. Thus, with either round lug arrangement of FIG. 25 or of FIG. 26, there is a greater possibility of the lug jamming than with the triangular lug arrangement of FIG. 24.

Figure 29:
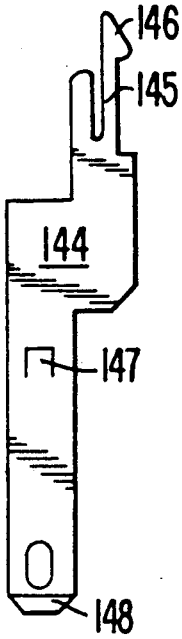
FIG. 29 illustrates a lamp terminal.
Figure 30:
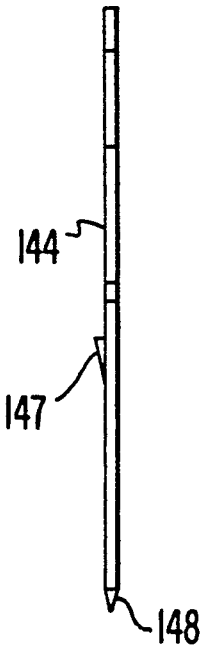
FIG. 30 illustrates a side elevational view of the lamp terminal of FIG. 29.
Figure 31:
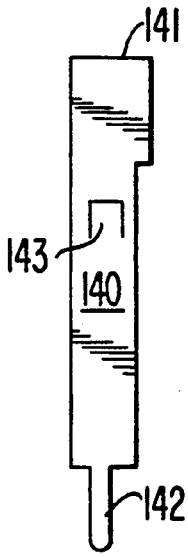
FIG. 31 illustrates a connection terminal.
Figure 32:
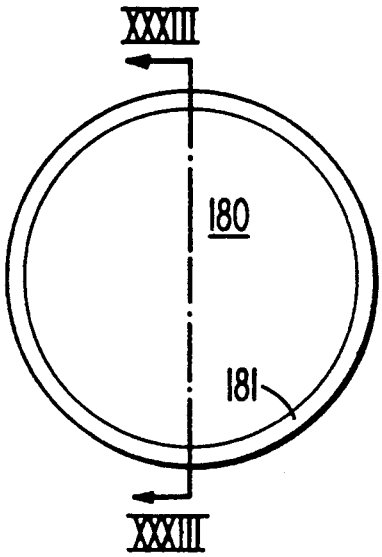
FIG. 32 illustrates a top view of the round button of the switch of FIG. 2.
Figure 33:
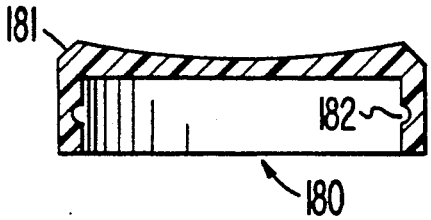
FIG. 33 illustrates a side sectional view of the button along line XXXIII—XXXIII of FIG. 32.

Illustrated in FIGS. 29 and 30 is quick-connect lamp terminal 144. Illustrated in FIG. 31 is power connection terminal 140. It can be appreciated that the quick-connect lamp terminal 144 of FIGS. 29 and 30 could be modified with a lower protrusion 142 as shown in FIG. 31 to also operate as a connection terminal to a printed circuit board. Likewise, the connection terminal 140 of FIG. 31 could be modified to a quick-connect state by removing the lower projection or end 142 and by adding the bottom portion 148 as shown in FIG. 29.

When installing the terminals of FIGS. 29–31, projections 143 and 147 are pressed inward, these terminals 140 and 144 are then placed into base 100 so that projections 143 and 147 expand outwardly to hold the terminals in the base. The arrow shaped prong of cantilever-type end 145 of lamp terminal 144 presses against lamp lead 166 so that lighting member lead 166 is in tight contact with lamp terminal 144.

Figure 34:
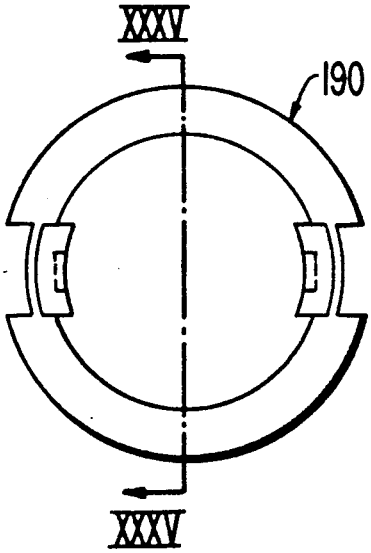
FIG. 34 illustrates a bottom view of the round diffuser of the switch of FIG. 2.
Figure 35:
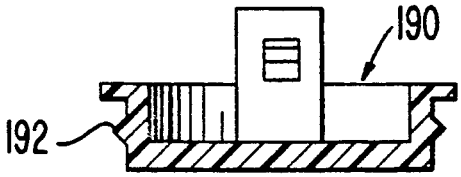
FIG. 35 illustrates a side sectional view of the diffuser along line XXXV—XXXV of FIG. 34.

Shown in FIGS. 1, 2, 32 and 33 is round button 180. Round button 180 has beveled top edge 181 and groove 182 for engaging diffuser 190. Shown in FIGS. 2, 34 and 35 is a bottom view and side sectional view of diffuser 190. Diffuser 190 has projection 192 which engages groove 182 on button 180. Button 180 and diffuser 190 move reciprocally with plunger 61.

Even though the actual switching mechanism is of a round shape, the button and diffuser can be of a square or rectangular shape. Without modifying the switch mechanism, one could shape the top portion of the housing, above surface 48, to be square or rectangular. One could then place the round switch elements such as plunger 61 and base 100 in housing 40 while having a square or rectangular shaped upper portion. Thus, a square or rectangular diffuser could act against substantially a cylindrical plunger 61.

A method of assembling a switch in accordance with this invention will be described. This method includes the steps of providing a housing 40 having an interior portion 42 with an opening to the exterior thereof. This housing includes guiding surfaces 47 and radially spaced saw teeth 43. Guiding surfaces 47 and saw teeth 43 are molded integrally to interior portion 42 of housing 40. This method also includes inserting a movable switching member 60, having plunger 61, rotatable latching ring 80, spring 170 and slidable terminal 172 on the plunger, through the housing opening and within the interior of housing 40 with the plunger being reciprocally movable in the housing and with rotation preventing projections 64, 66 and 68 of the plunger slidably interengaging guiding surfaces 47 of the housing.

This method also includes inserting a biasing member 120 through the housing opening with an end 121 of biasing member 120 disposed against end 69 of plunger 61 as in FIGS. 4A and 4B. It further includes inserting substantially cylindrical portion 101 of base 100 through the housing opening and against opposite end 122 of biasing member 120. Further, this method includes aligning saw teeth 106, which are integrally molded on cylindrical portion 101 of base 100, to be circumferentially offset of saw teeth 43 on housing 40 so that when the plunger 61 is depressed, lug 83 on rotatable latching ring 80 contacts one of saw teeth 106 on the base to rotate the ring. Also, every other time plunger 61 is released from its depressed portion, lug 83 on rotatable ring 80 contacts one of saw teeth 43 on the housing to restrain the plunger in a latched position.

The base, housing, plunger and locking ring are all preferably made of a resilient electrically insulating material such as nylon.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A switch comprising:

a housing having a substantially cylindrical interior portion;

a movable switching member, disposed substantially within said interior of said housing and including a reciprocally movable plunger having successive released, latched and depressed positions relative to said housing interior portion;

functional surfaces of substantially cylindrical form, disposed adjacent and in a substantially fixed position relative to said interior portion of said housing and including guiding surfaces aligned in the direction of movement of said plunger;

said plunger having means, interengaging with said guiding surfaces, for preventing rotation of said plunger during reciprocal movement of said plunger;

said movable switching member also including a substantially C-shaped rotatable latch ring disposed on said plunger and having a radially extending lug;

said plunger also having means for holding said rotatable C-shaped ring in a fixed latitudinal position about a portion of said plunger; and said functional surfaces also including:

radially spaced lug directing surfaces disposed so that when said plunger is moved into its depressed position, a lug directing surface contacts said lug to rotate said ring; and radially spaced lug latching surfaces, circumferentially offset from said lug directing surfaces and disposed so that every other time said plunger is moving from its depressed toward its released position, one of said lug latching surfaces contacts said lug of said ring to restrain said plunger in its latched position.

2. A switch as in claim 1, further comprising means, disposed substantially within said interior of said housing and having an end in contact with said plunger, for biasing said plunger towards its released position in the absence of sufficient pressure on said plunger in the opposite direction.

3. A switch as in claim 1, wherein said guiding surfaces include a top surface which stops said plunger rotation preventing means from moving in a direction away from said plunger's depressed position when said plunger is in its released position.

4. A switch as in claim 3, wherein said top surface contacts plunger rotation preventing means on each of opposite sides of said plunger.

5. A switch comprising:

a housing having a substantially cylindrical interior portion;

a movable switching member, disposed substantially within said interior of said housing and including a reciprocally movable plunger having successive released, latched and depressed positions relative to said housing interior portion;

said housing interior portion including guiding surfaces of substantially cylindrical form, molded integrally thereon, and aligned in the direction of movement of said plunger;

said plunger having means, interengaging with said guiding surfaces, for preventing rotation of said plunger during reciprocal movement of said plunger;

said movable switching member also including a rotatable latch ring disposed on said plunger and having a radially extending lug;

said plunger also having means for holding said rotatable ring in a fixed latitudinal position about a portion of said plunger;

a base having a substantially cylindrical portion disposed in a substantially fixed position within the interior of said housing, said substantially cylindrical portion of said base including radially spaced surfaces molded integrally thereon and disposed so that when said plunger is moved into its depressed position, one of said radially spaced surfaces of said base contacts said lug of said ring to rotate said ring; and said housing interior portion further including radially spaced surfaces molded integrally thereon, circumferentially offset from said spaced surfaces on said base, and disposed so that every other time said plunger is moving from its depressed towards its released position, one of said radially spaced surfaces of said housing contacts said lug of said ring to restrain said plunger in its latched position.

6. A switch as in claim 5, further comprising means, having one end disposed on said base and another end in contact with said plunger, for biasing said plunger towards its released position in the absence of sufficient pressure on said plunger in the opposite direction.

7. A switch as in claim 5, wherein said guiding surfaces include a top surface which stops said plunger rotation preventing means from moving in a direction away from said plunger's depressed position when said plunger is in its released position.

8. A switch as in claim 7, wherein said top surface contacts said plunger rotation preventing means on each of opposite sides of said plunger.

9. A switch comprising:

a housing having a substantially cylindrical interior portion;

a movable switching member, disposed substantially within said interior of said housing and including a reciprocally movable plunger having successive released, latched and depressed positions relative to said housing interior portion;

functional surfaces of substantially cylindrical form, disposed adjacent and in a substantially fixed position relative to said interior portion of said housing and including guiding surfaces aligned with the direction of movement of said plunger;

said plunger having means, interengaging with said guiding surfaces, for preventing rotation of said plunger during reciprocal movement of the said plunger;

said movable switching member also including a rotatable latch ring disposed on said plunger and having a radially extending lug, said lug having a first surface which is aligned with the direction of movement of said plunger and second and third surfaces which are inclined relative to said first surface;

said plunger also having means for holding said rotatable ring in a fixed latitudinal position about a portion of said plunger; and means, disposed substantially within said interior of said housing, for biasing said plunger towards its released position in the absence of sufficient pressure on said plunger in the opposite direction; and said functional surfaces also including:

radially spaced lug directing teeth, each tooth having a fourth surface which is aligned with the direction of movement of said plunger and a fifth surface which is inclined relative to said fourth surface so that when said plunger is moved into its depressed position, said fifth surface of one of said lug directing teeth contacts said second surface of said lug to rotate said ring; and radially spaced lug latching teeth, circumferentially offset from said lug directing teeth, with each tooth having a sixth surface which is aligned with the direction of movement of said plunger and a seventh surface which is inclined relative to said sixth surface so that upon alternate releases of said plunger from the depressed position, said seventh surface of one of said lug latching teeth contacts said third surface of said lug to restrain said plunger in the latched position.

10. A switch as in claim 9, wherein said guiding surfaces include a top surface which stops said plunger rotation preventing means from moving in a direction away from said plunger's depressed position when said plunger is biased to its released position.

11. A switch as in claim 10, wherein said top surface contacts plunger rotation preventing means on each of opposite sides of said plunger.

12. A switch as in claim 9, wherein said guiding surfaces define recesses aligned with the direction of movement of said plunger and each of said lug latching teeth is separated by one of said recesses.

13. A switch as in claim 9, wherein said inclined fifth and seventh surfaces of said respective lug directing and lug latching teeth are at approximately a 45° angle to their respective fourth and sixth surfaces.

14. A switch as in claim 9, wherein:

said lug directing surfaces are integrally disposed on a substantially cylindrical portion of a base;

said substantially cylindrical portion of said base is in a substantially fixed position within said interior of said housing;

said base includes means for receiving an end of said biasing means; and said plunger includes means for receiving an opposite end of said biasing means.

15. A switch as in claim 14, further comprising first and second electrical terminals disposed in said base, each terminal having a first end projecting from said base into the interior of said housing and a second end projecting outside of said housing from an opposite portion of said base.

16. A switch as in claim 15, further comprising a third electrical terminal disposed on said plunger for contacting both of said first and second electrical terminals when said plunger is in its depressed and in its latched positions.

17. A switch as in claim 9, further comprising an electrical terminal slidably disposed on a portion of said plunger.

18. A switch as in claim 17, further comprising:

a base having a substantially cylindrical portion disposed in a substantially fixed position within said interior of said housing;

a pair of electrical terminals disposed in said base, each terminal having a first end projecting from said base into the interior of said housing for contact with said slidable terminal on said plunger when said plunger is in its depressed and in its latched positions.

19. A switch as in claim 18, further comprising a spring having one end received by said plunger and another end received by said terminal on said plunger for forcing said slidable terminal on said plunger against said pair of electrical terminals in said base when the plunger is in its depressed and in its latched positions.

20. A switch as in claim 9, further comprising:

a lighting member disposed within the interior of said housing and including a lead; and a lamp terminal disposed in said base and having a cantilever-like arm projecting into the interior of said housing so that when said plunger is in its depressed and latched positions said cantilever arm is forced against said lead.

21. A switch as in claim 9, wherein said first, second and third surfaces of said lug define a triangular side wall shape.

22. A switch as in claim 21, wherein said second and third surfaces of said lug are of equal length.

23. A switch comprising:

a housing having a substantially cylindrical interior portion including:

saw teeth integrally molded on the interior portion of said housing; and guiding surfaces defining recesses formed between each of said teeth on the interior surface of said housing;

a plunger disposed substantially within said interior of said housing and having successive released, latched and depressed positions, said plunger including:

means, slidably engaged in recesses on the interior portion of said housing, for preventing rotation of said plunger during reciprocal movement of said plunger within said housing; and ridges defining a groove about said plunger;

said housing also including means, integrally molded on the interior portion of said housing, for stopping movement of said plunger when said plunger is in its released position;

a locking ring loosely rotating in a portion of said groove of said plunger and having a radially extending lug;

a base, having a substantially cylindrical portion disposed in a substantially fixed position within said housing interior, said substantially cylindrical portion of said base including saw teeth, molded integrally thereon and circumferentially offset from said saw teeth of said housing so that when said plunger is in a fully depressed position, said lug on said locking ring initially engages a tooth of said base to rotate said ring and every other time said plunger is released from its depressed position, said lug engages a tooth of said housing to restrain said plunger in its latched position; and means, having one end disposed on said base and another end in contact with said plunger, for biasing the plunger to its released position in the absence of sufficient pressure on said plunger in the opposite direction and in the absence of any lug on said ring being restrained by a tooth of said housing.

24. A switch as in claim 23, further comprising first and second electrical terminals disposed in said base, each terminal having a first end projecting from said base into said interior of said housing and a second end projecting outside of said housing from an opposite portion of said base.

25. A switch as in claim 24, further comprising a third electrical terminal disposed on said plunger for contacting both of said first and second electrical terminals when said plunger is in its depressed and in its latched positions.

26. A switch as in claim 23, wherein:

said lug on said ring has a first surface which is aligned with the direction of movement of said plunger and second and third surfaces which are inclined relative to said first surface;

said second surface is in surface-to-surface contact with one of said base saw teeth when said plunger is moved into its depressed position; and said third surface is in surface-to-surface contact with one of said housing saw teeth every other time said plunger is released from its depressed position.

27. A method of assembling a switch comprising the steps of:

providing a housing having an interior portion with an opening to the exterior thereof, said housing including guiding surfaces and radially spaced saw teeth, with said guiding surfaces and saw teeth molded integrally to said interior portion of said housing;

inserting a movable switching member, having a plunger, spring, sliding terminal, and rotatable latching ring on said plunger, through said housing opening and within said housing interior with said plunger being reciprocally movable in said housing and with rotation preventing projections of said plunger slidably interengaging said guiding surfaces of said housing;

inserting a biasing member through said housing opening with an end of said biasing member disposed against said plunger;

inserting a substantially cylindrical portion of a base through said housing opening and against an opposite end of said biasing member; and aligning saw teeth, which are integrally molded on said cylindrical portion of said base, to be circumferentially offset of said saw teeth on said housing so that when said plunger is depressed, a lug on said rotatable ring contacts one of said teeth on said base to rotate said ring, and so that every other time said plunger is released from its depressed position a lug on said rotatable ring contacts one of said teeth on said housing to restrain said plunger in a latched position.

* * * * *